United States Patent [19]

Steigerwald et al.

[11] Patent Number: 4,483,439

[45] Date of Patent: Nov. 20, 1984

[54] TWO-COMPONENT PACKAGING FOR POURABLE MEDIA

[75] Inventors: Franz Steigerwald, Griesheim; Franz Adler, Stockstadt, both of Fed. Rep. of Germany

[73] Assignee: Wella Aktiengesellschaft, Darmstadt, Fed. Rep. of Germany

[21] Appl. No.: 425,100

[22] PCT Filed: Feb. 18, 1982

[86] PCT No.: PCT/EP82/00032

§ 371 Date: Sep. 20, 1982

§ 102(e) Date: Sep. 20, 1982

[87] PCT Pub. No.: WO82/03212

PCT Pub. Date: Sep. 30, 1982

[30] Foreign Application Priority Data

Mar. 14, 1981 [DE] Fed. Rep. of Germany ..... 3109921

[51] Int. Cl.[3] ..... B65D 51/28; B65D 81/32

[52] U.S. Cl. ..... 206/219; 206/219; 206/568; 215/DIG. 1; 215/DIG. 8; 220/366

[58] Field of Search ..... 206/63.5, 219, 220, 206/221, 222, 568; 215/6, DIG. 8, DIG. 1; 366/602; 220/366

[56] References Cited

U.S. PATENT DOCUMENTS

| | | | |
|---|---|---|---|
| 2,207,543 | 7/1940 | Knapp | 215/13 R |
| 3,139,121 | 6/1964 | Ballin | 215/DIG. 8 |
| 3,144,966 | 8/1964 | Cook | 222/137 |
| 3,221,917 | 12/1965 | De Santo et al. | 206/221 |
| 3,344,914 | 10/1967 | Bloom et al. | 206/63.5 |
| 3,514,008 | 5/1970 | Dorn | 215/6 |
| 3,514,029 | 5/1970 | Powell | 215/6 |
| 3,521,745 | 7/1970 | Schwartzman | 206/222 |
| 3,625,349 | 12/1971 | Muhlbauer | 206/63.5 |
| 3,810,469 | 5/1974 | Hurschman | 206/222 |
| 3,856,138 | 12/1974 | Maekawa et al. | 206/221 |

*Primary Examiner*—George E. Lowrance
*Assistant Examiner*—Jimmy G. Foster
*Attorney, Agent, or Firm*—Michael J. Striker

[57] ABSTRACT

The packaging is particularly suitable for containing hair coloring components, namely the hair color itself and a second fluid, usually peroxide, which must be stored separately and well mixed immediately before being applied to the hair. The two fluids, for storage purposes, are housed in two different concentrically disposed containers (1,6). Immediately before hair treatment in the inner container (6), the base of which is adjacent the base member (2) of the outer container (1), is displaced outwardly as far as a stop (8) and thus simultaneously a good mixing of the two fluids is effected. A sealing lip (17), which releases possible overpressure, a deformable base member (2), and a groove (21) prevent the occurrence of overpressure inside the two containers.

21 Claims, 12 Drawing Figures

TWO-COMPONENT PACKAGING FOR POURABLE MEDIA

TECHNICAL FIELD

The invention relates to a two-component packaging for pourable media, which comprises an outer container for one component and an elongate inner container for the other component. The inter container, in storage position, is located at least partially inside the outer container and is slidably displaceable outwardly into an operating position.

Packagings of this type have become known in numerous different embodiments but hitherto these have not proved absolutely satisfactory with respect to storage and/or use.

DISCLOSURE OF THE INVENTION

The invention is based on the object of providing a new type of two-component packaging for pourable media by simple constructive measures without particular additional expense, which packaging may be both easily opened and handled by the user and in which the components are well mixed for use and the filling of the packaging can satisfy the requirements of series production.

This object is achieved in the case of a two-component packaging of the type initially described in that in the neck section of the outer container a sealing lip is provided which is rigidly connected to the outer container and sits close to the inner container; at its outer side the inner container bears a radially outwardly extending projection, and the outer container, in the vicinity of the sealing lip, bears a stop for this projection which limits the longitudinal displacement of the inner container during the transition from the storage position to the operating position; and the outer container has a base member whose central zone is surrounded by projections which are disposed in an annular manner and which, in the storage position, lies closely against the lateral wall of the inner container.

Further developments of the invention which in particular eliminate the diffusion of air/oxygen into the interior of the packaging, and measures which, if an inner overpressure builds up, render this inoffensive or vent it, are characterised in the subclaims and will subsequently be described in connection with the accompanying drawings which illustrate preferred embodiments and are partially schematically simplified. In the drawings, parts corresponding to each other are given the same reference numerals and all details which are not necessary for understanding the invention have been omitted.

BEST MODE OF CARRYING OUT THE INVENTION

Figure 1:
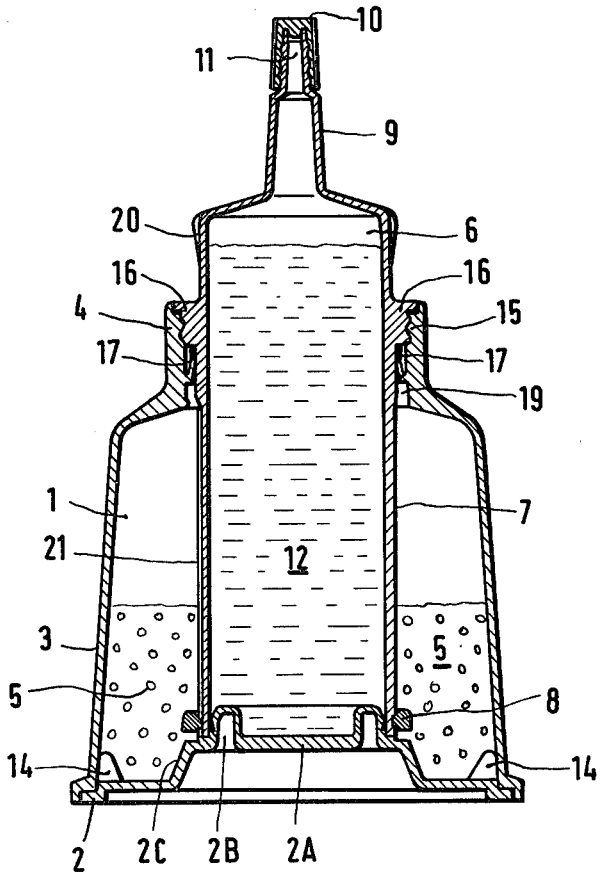
FIG. 1 is a longitudinal section through a two-component packaging comprising an outer container and an inner container, the latter being in the storage position.

In FIGS. 1 to 7 a two-component packaging for hair colour is illustrated. The packaging comprises two concentric containers which are connected to each other in a very special manner.

The outer container 1, which has a base member 2, a lateral wall 3, and a neck section 4, contains fluid peroxide 5. The base member 2 and the wall 3 are of polyethylene or, preferably, polypropylene. The inner container 6, which has a cylindrical lateral wall 7 in the form of a casing with an annular lateral projection 8 at the lower end, as well as a neck 9 having an outlet aperture 11 which may be closed by means of screw cap 10, contains the fluid hair colour 12. The base member 2 of the outer container 1 simultaneously forms the lower closure and the base of the inner container 6. The base member 2 has a central circular zone 2A which is surrounded by an annular elevation 2B, the outer side of which lies close against the inner side of the lateral wall 7 of the inner container 6. Outside the annular elevation 2B the base member is bevelled at 2C in order to maintain the radial force components as low as possible when overpressure occurs in the outer container, and to prevent leakage. The circular zone 2A has a greater thickness than the annular elevation 2B in order to obtain the greatest possible tightness with respect to diffusion.

As a result of this special development the sealing area causing the sealing of the inner container may deform when overpressure occurs inside the inner container 6 and permits exchange of gas or fluid in the direction of the space inside the outer container 1. At the same time, however, it is also brought about that if underpressure occurs as a result of oxygen consumption by the hair colour, the sealing system between lateral wall 7 of the inner container 6 and the annular elevation 2B on the contrary produces a higher surface pressure.

The base member 2 is equipped with four centering ribs 14 in order to facilitate introduction of base member 2 into the outer container 1. The base member is more flexible and more easily deformable than the walls 3 and 7.

Figure 2:
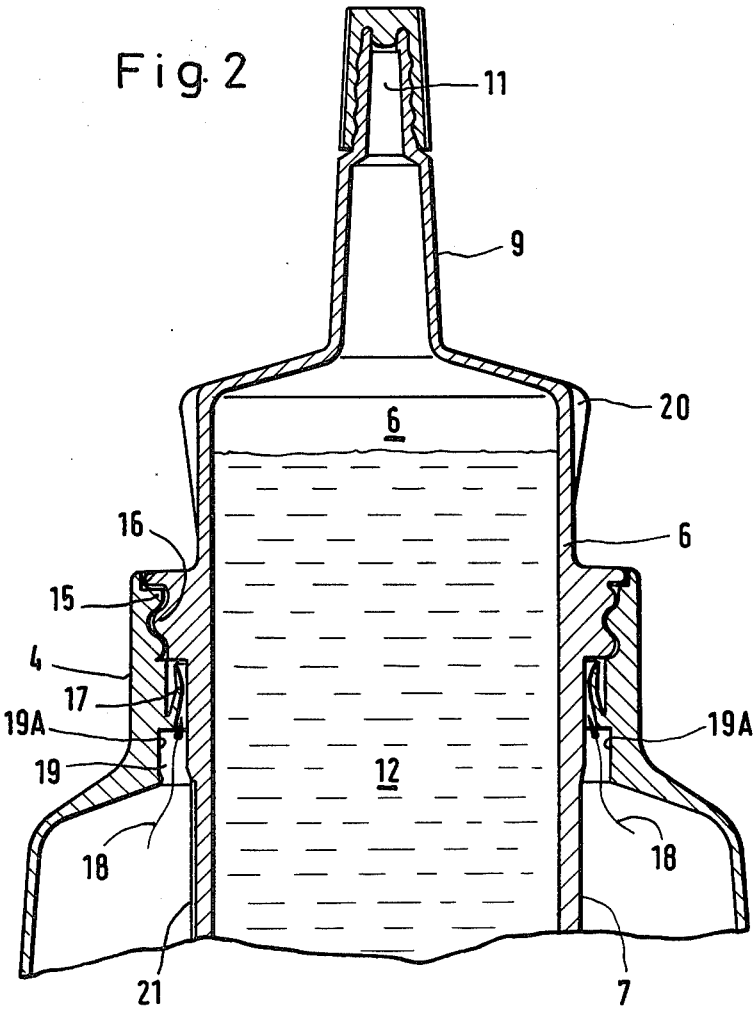
FIG. 2 shows the upper part of FIG. 1 on an enlarged scale.

The outer container 1—as can be seen well from FIG. 2, which is on a larger scale—has a neck section 4 at its end shown at the top in the Figure, having an internal thread 15 into which an external thread 16, which is formed as a counter-member and is located at the outer side of the inner container 6, is screwed. Below the two threads 15 and 16 a sealing lip 17 is disposed which is formed in such a way that the inner container 6 may be inserted from above into the outer container 1. Furthermore, the sealing lip 17 is formed such that it abuts in a sealing manner against the lateral wall 7 with slight prestressing, after insertion of the inner container inside the outer container. The sealing lip 17 is also used as a safety valve against too high pressure in the outer container. If this inner pressure increases—for whatever reasons—above a predetermined value, the sealing lip is lifted by the lateral wall 7 and the gas overpressure is released in the direction of arrow 18 (FIG. 2).

Figure 4:
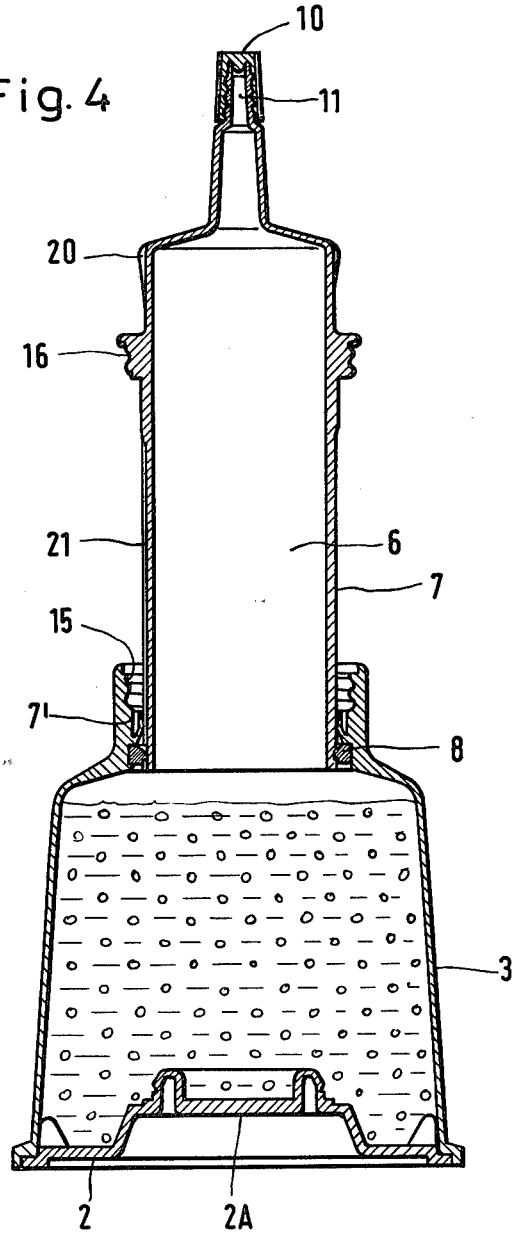
FIG. 4 is similar to FIG. 1 but with the inner container in the operating position, i.e. drawn out in the longitudinal direction.
Figure 5:
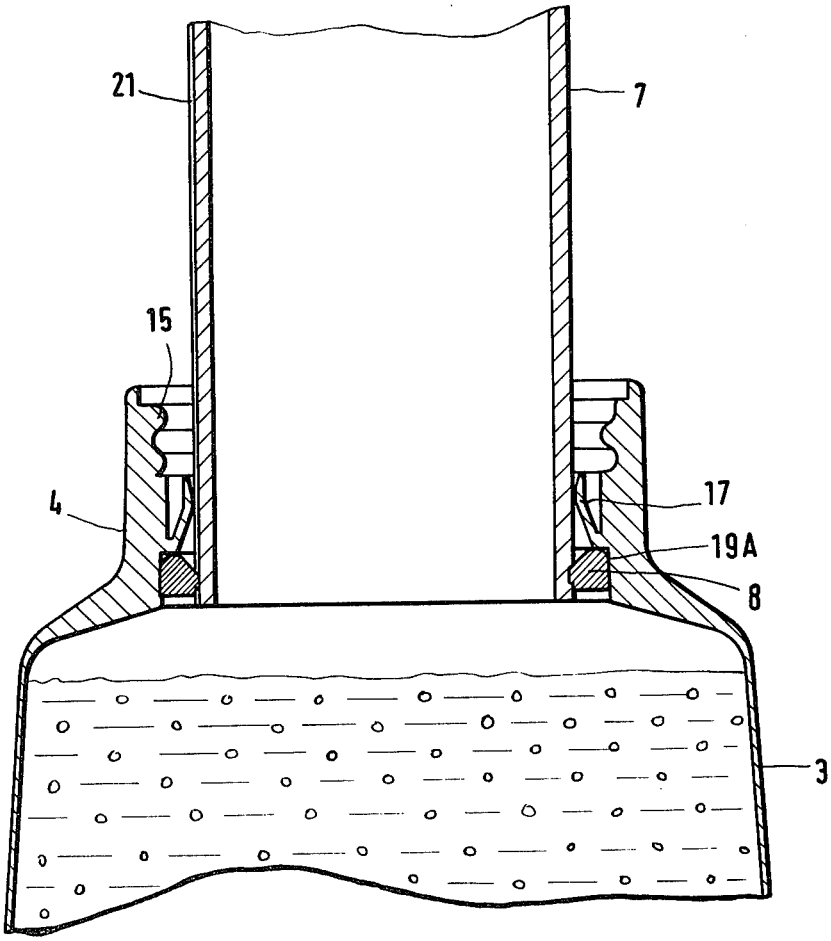
FIG. 5 shows the middle part of FIG. 4 on an enlarged scale.

On the side, of the sealing lip 17, facing the inner chamber of the outer container 1 an annular chamber 19 is provided which is dimensioned with respect to the lateral projection 8 of the inner container 6 in such a way that, in the operating position shown in FIGS. 4 and 5, the annular projection 8, which is rigidly connected to the lateral wall 7 of the inner container, fits exactly into the annular chamber 19. As a result of this it is ensured that the inner container 6, which has the outlet aperture 11 in its neck 9, is well secured in the outer container 1 in the operating position. Between the part provided with the external thread 16 and the outlet aperture 11, the inner container 6 has a region formed as a gripping member 20 with a structured (e.g. milled) surface.

In order to transfer the outer container 1 from the storage position shown in FIG. 1 to the operating position shown in FIG. 4, the outer container 1, having an oval cross-section, is advantageously held with one hand and the gripping member 20 is rotated with the other hand so that the inner container 6 is unscrewed from the neck 4 of the outer container. As a result the lower end of the cylindrical lateral wall 7 of the inner container 6 is removed from the annular elevation 2B of the base member 2 and, after termination of the unscrewing process, the inner container 6 is pulled through the neck of the outer container 1, in the longitudinal direction, until the annular projection 8 pulled into the annular chamber 19 limits the longitudinal movement and simultaneously the relative position of the two containers 1 and 6 is fixed. A good mixture of the fluid hair colour 12 with the fluid peroxide 5 is thereby immediately obtained.

The lateral projection 8, which is pressed onto the lower end of the lateral wall 7, is formed slightly conically at the outer periphery 8A (FIG. 3) and the corresponding counter-surface 19A (FIGS. 3 and 5) of the annular chamber 19 is similarly conically formed in order to ensure a good fit in the operating position (FIGS. 4 and 5).

Figure 6:
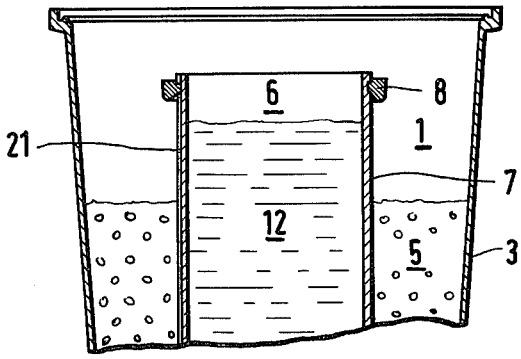
FIG. 6 shows the lower part of the packaging inverted for filling, before fitting the base member.
Figure 7:
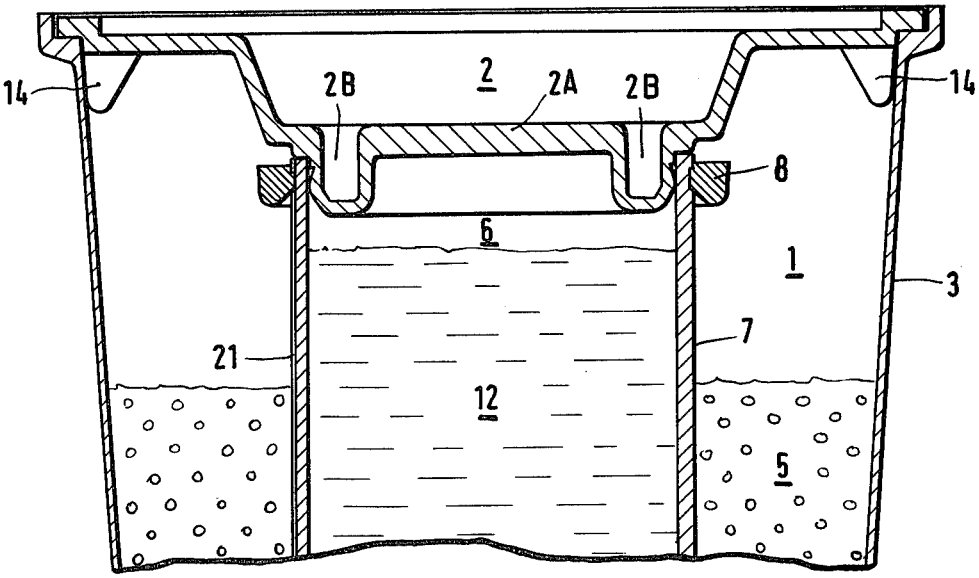
FIG. 7 is similar to FIG. 6 but on an enlarged scale and with the base member applied and welded to the edge of the outer container.

The process of filling the packaging with the two fluid components, as shown in FIG. 6, occurs with the inner container 6 pushed in, the base member 2 removed, and the packaging inverted so that the two apertures of the two containers are directed upwards. Subsequently the base member 2 is inserted, as is shown on a larger scale in FIG. 7, and is fused at the edge with the lateral wall 3 of the outer container 1. As can be seen in FIG. 7, the base member 2 is inserted in an annular groove formed by the lateral wall 3 of the outer container 1. The groove is delimited by a stop which projects inwards from the wall 3 and against which the base member 2 abuts.

The volume of the outer container is such that, when the inner container is being transferred to the operating position, i.e. while the inner container is being pulled up, despite the fact that the outer wall falls in as a result of the underpressure which occurs, the filling level of the peroxide is below the lower end of the raised inner container. In this way good mixing of the two components is rendered possible.

Usually it cannot be prevented that peroxides give off some oxygen. As a result of this a certain overpressure arises. As a result of the increase in volume occurring during the transfer into the operating position, an existing overpressure may be reduced. This overpressure assists the pulling-out of the inner container 6, which is to be performed manually.

In general it is advantageous to provide a longitudinal duct, formed as a groove 21, on the outer side of the cylindrical wall 7, formed as a casing, of the inner container 6. This duct is disposed in such a way that, in the storage position, it is located with its entire length in the interior of the outer container 1, but in the operating position is partially inside the outer container 1 and partially outside this container. As a result of this the inner space may be vented shortly before reaching the operating position and, depending on the type and amount of filling, an overpressure or underpressure reduced.

Figure 3:
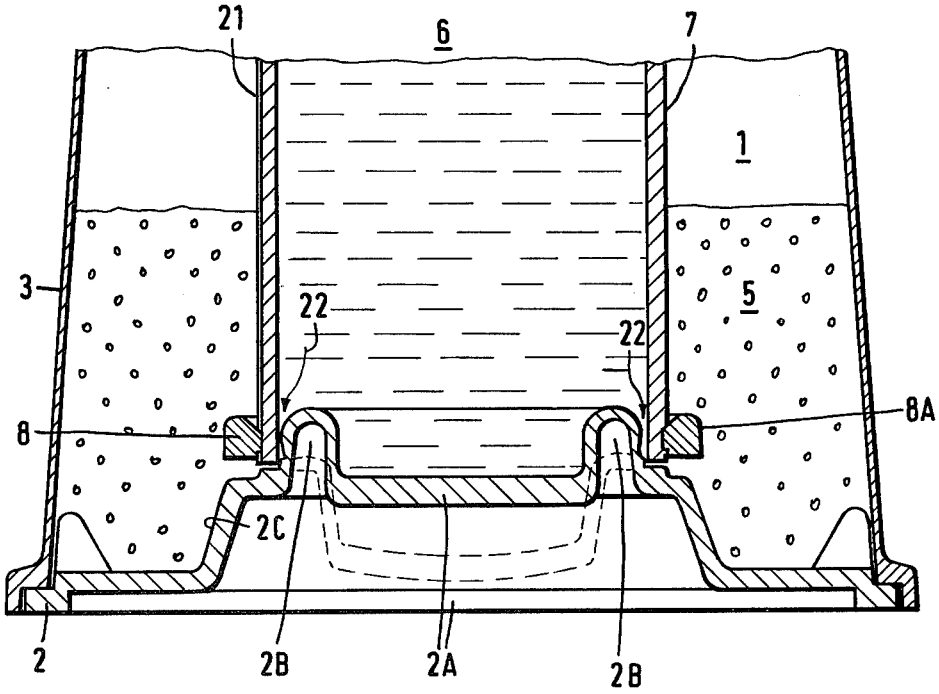
FIG. 3 shows the lower part of FIG. 1 on an enlarged scale, indicating in broken line the effect of an overpressure in the inner container.

If an appreciable overpressure occurs in the interior of the inner container 6 the annular elevation 2B is somewhat deformed and—as is indicated by arrow 22 in FIG. 3—and amount of fluid passes over into the outer container 1, whereby the overpressure in the inner container is reduced.

If great overpressure occurs in the interior of the inner container 6 the central section 2A of the base member 2 may be thereby deformed in the manner shown in broken line in FIG. 3. In this way extensive security against damaging of the packaging by overpressure in the inner container 6 is ensured.

Figure 8:
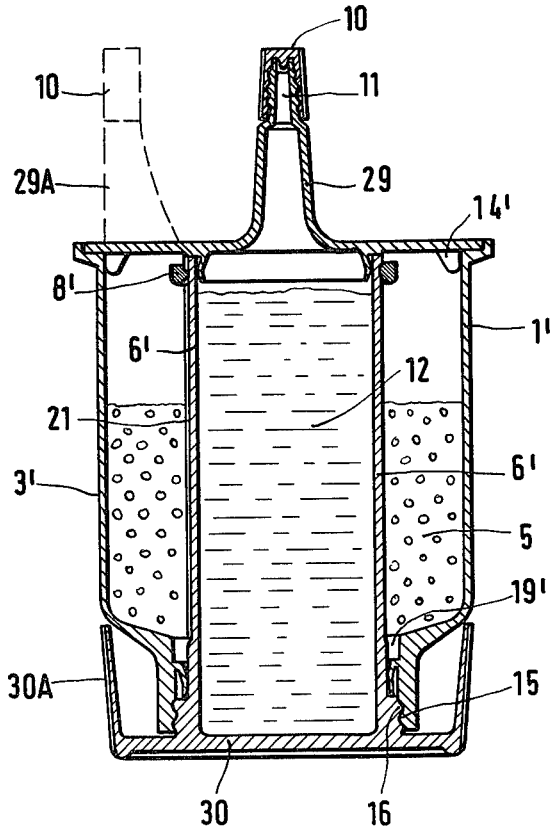
FIG. 8 shows another embodiment of a two-compartment packaging in longitudinal section.

In the case of the embodiment shown in longitudinal section in FIG. 8, the outlet opening 11, closed by a screw cap 10, is disposed in a neck attachment 29 which is connected to the outer container 1.

The inner container 6' bears at its lower end an external thread 16 which is screwed into an internal thread 15 of the outer container 1'. The bottom of the inner container 6' comprises on the exterior a flange 30A which is curved upwards. If the external thread 16 is unscrewed from the internal thread 15 by twisting the flange 30A relative to the lateral wall 3' of the outer container 1' and the inner container 6' is then pulled downwards until the annular lateral projection 8', which is secured to the lateral wall 7' which is in the form of a cylinder jacket, arrives at the base of the annular chamber 19' which base acts as a stop, good and rapid mixing of the two components which have been stored separately is ensured. It is also advantageous in this case to provide a duct formed as a groove 21 in the outer side of the cylindrical wall 7' of the inner container 6'.

In a variant of the embodiment shown in FIG. 8—as is shown in broken line—the neck attachment 29A is disposed eccentrically at the edge.

The primed numerals of FIG. 8 correspond functionally to the components illustrated in FIGS. 1 to 7 and designated with the same numerals but without a prime.

The two-component packaging described above further has the two following advantages. By pulling out the inner container 6 or 6' the overpressure occurring when the two components which react with each other are mixed, is diverted outwardly by the groove 21 so that when the screw cap 10 is unscrewed no fluid spatters out of the outlet aperture 11 against the user. As a result of the special construction of the outer and inner containers no residual amount remains in the inner space in the region of the annular chamber 19 or 19' sealed by the annular projection 8 or 8' when the fluid is poured out.

Figure 9:
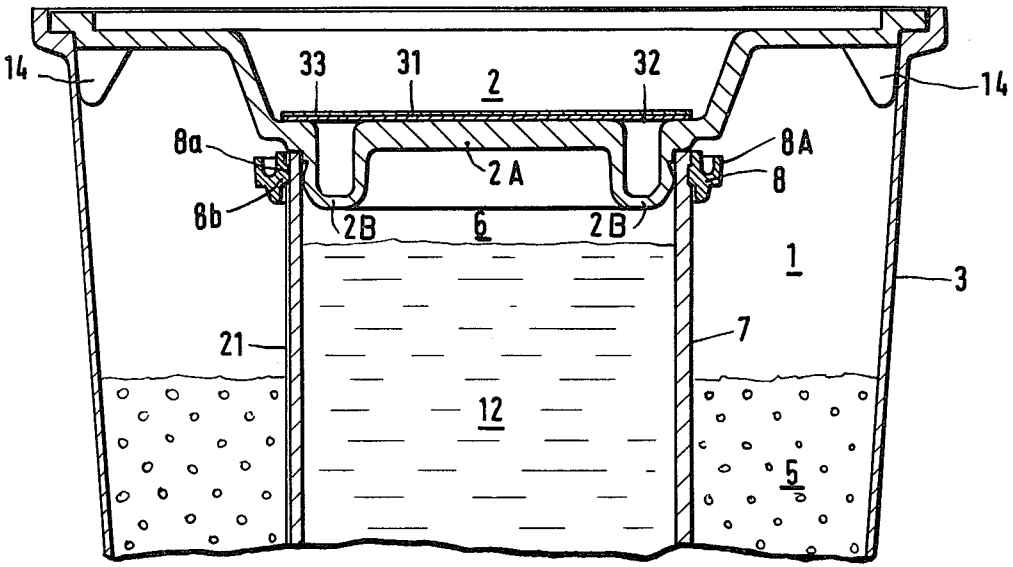
FIG. 9 is a detail (in longitudinal section) of another embodiment similar to FIG. 7, in which the outer side of the central zone in the base area of the inner container is covered by an aluminum bonding sheet.

In order that the annular projection 8, after mounting on the lower end of the inner container 6 after previous assembling of the inner container 6 in the outer container 1, is reliably secured there a snap connection is formed with an annular groove 8*a* on the outer side of the inner container 6 and with a rib-shaped projection 8*b* on the annular projection 8, as is shown in FIG. 9. In the case of this embodiment (otherwise similar to FIG. 7) the base member 2 is furthermore covered on the outer side of the central zone 2A in the base area of the inner container 6. The aluminum bonding sheet 31 consists of an inner plastics sheet 32 and an outer aluminum sheet 33, which is glued to the plastics sheet, the base member 2 being rigidly fused with the plastics sheet 32 before assembly. As a result of this, oxygen diffusion from the exterior to the interior is eliminated to a large extent, so that hair colour in the inner container 6 acting in an oxidative manner is protected against the action of atmospheric oxygen.

In the case of a preferred embodiment the outer container 1 has an oval cross-section, FIGS. 1 to 9 in each case illustrating the breadth of this container 1, whilst its narrow side is not shown.

Figure 10:
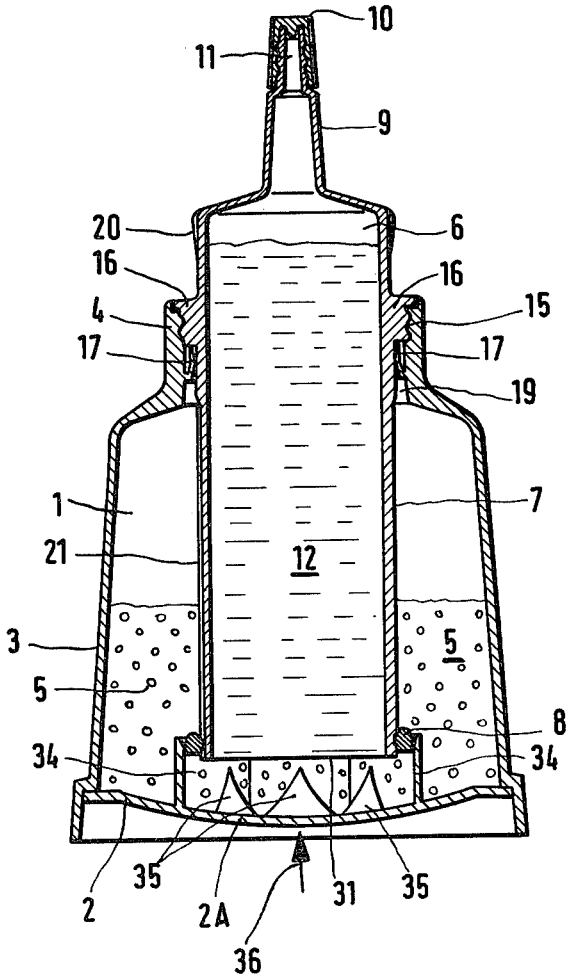
FIG. 10 is a longitudinal section through a modified embodiment, similar to FIG. 1.

In the case of a further embodiment according to FIG. 10, deviating from the embodiment of FIG. 1, the base member 2 is formed differently and the aluminum bonding sheet 31 disposed outside the base member 2 (in the case of FIG. 9), in a different manner, is fused onto the lower end of container 6 after termination of the filling process.

The base member 2 is curved convexly, is resiliently deformable, and bears on its inner side a plurality of projections 34 (only two of which are visible in FIG. 10) which are distributed on the periphery, surround the central zone 2A in an annular manner, and, in the storage position, contiguously surround the annular projection 8 from the exterior. The free end of these projections 34 which projects axially is in each case conically bevelled on the inner side, so that a conically opening funnel results from the improved guiding of the annular projection 8 when the base member 2 is mounted after termination of the process of fusion to the aluminum bonding sheet 31. Furthermore, the inner side of the base member 2 bears cutter teeth 35 which project inwardly in an axial and annular manner and in the storage position do not quite come into contact with the aluminum bonding sheet 31 of the inner container 6; in the storage position they can be brought to lie with a close fit inside the inner wall of container 6 by pressing the central zone 2A in the base.

The mode of operation is as follows. To use this two-component packaging the aluminum bonding sheet 31 is cut out in an annular member by pressure (for example, of the thumb) in the direction of arrow 36 whilst rotating simultaneously the inner container 6 by the unscrewing motion—screw threads 15,16—so that the two components—as described above—may be mixed and delivered.

Figure 11:
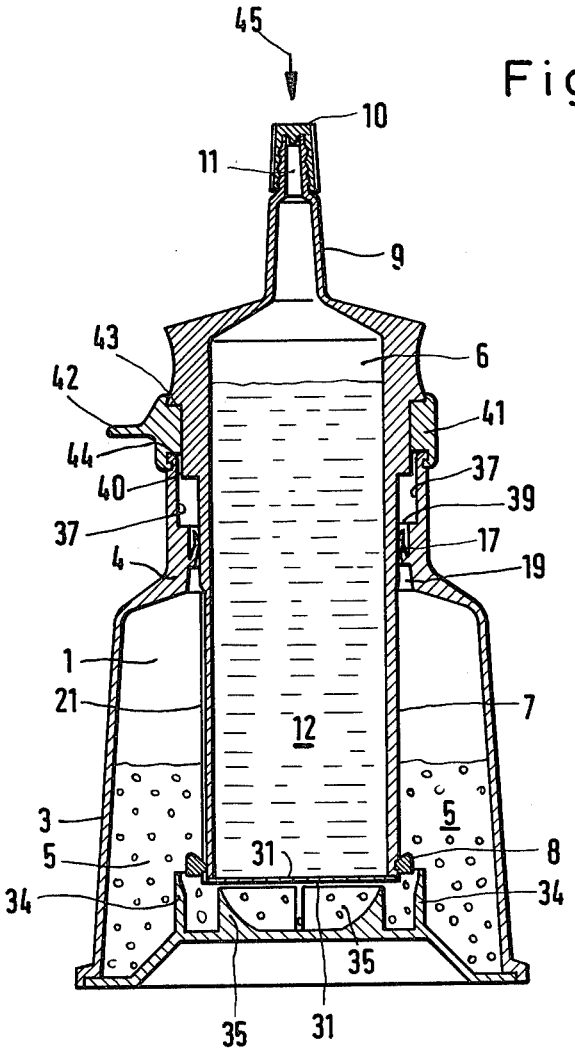
FIG. 11 is a longitudinal section through a further embodiment, similar to FIG. 10.

In a further embodiment according to FIG. 11, deviating from FIG. 10, the base member is non-deformable, or only partly deformable (as is the case with the embodiment of FIG. 1), and in order to cut out the aluminum bonding sheet 31 in this case the base member 2 is not pressed in from the outside, but the inner container 6 has to perform an additional downward movement, preferably together with a rotational movement. This may be done with a container 6 which, in the storage position, is not completely screwed in about the axial length of the cutting stroke, having a screw connection which is not illustrated (similar to the screw threads 15 and 16 in FIG. 10). In FIG. 11 at the neck section 4 a sliding fit is provided instead of a screw connection, which sliding fit is provided by a coaxial hollow cylindrical recess 37, formed in the inner wall of the neck section 4, with a surrounding wall 39 which limits the stroke and projects radially inwardly, and a correspondingly adapted cylindrical outer surface 40 on the inner container 6. In the storage position an intermediate ring 41, with a perforated predetermined breaking point (not illustrated) and a gripping strap 42, is disposed between a flange 43 of the inner container 6 and the front surface 44 of the free end of the neck section 4 of the outer container 1.

The mode of operation is as follows: After tearing off the intermediate ring 41 by means of the gripping strap 42, which acts as a carrying means and original safety device, by axially displacing the container 6 in the direction of arrow 45 (lower limit of stroke by the cooperation of the flange 43 and the front surface 44) combined with a rotational movement, the aluminum bonding sheet 31 is cut out by means of the teeth 35. Subsequently, by axial displacement opposite to the direction of arrow 45, the inner container 6 is brought into the operating position by pulling out (similar to the manner of FIG. 4). The further mode of operation corresponds to the mode of operation described earlier with reference to FIG. 1.

In order that the outlet aperture 11, in the pouring-out position, is not sealed by the cut out and descending aluminum bonding sheet 31 when the contents of the container are discharged, in the embodiment according to FIG. 10, the rotational movement may be limited (e.g., in a manner which is not illustrated, by the screw threads 15 and 16) so that a small-angled area of the aluminum bonding sheet 31 is not cut out and acts as a flap hinge, whereby the sheet 31 is not freely movable. In a similar manner, in the embodiment according to FIG. 11, the cutter teeth 35, in a further embodiment which is not illustrated, may be replaced by an annular cutting knife which extends over an angle of somewhat less than 360°. In this way, dispensing with a rotational movement when pressing down the inner container 6, the aluminum bonding sheet 31 is not completely cut out, so that it is subsequently only swung out of the way.

Figure 12:
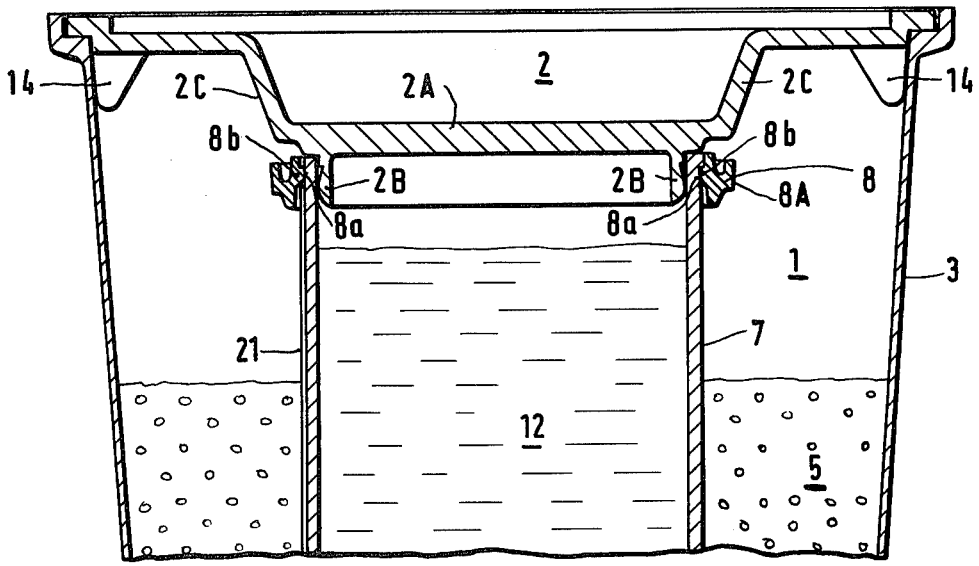
FIG. 12 is a detail of a further embodiment, similar to FIG. 7, with a modified base member.

The modified embodiment illustrated in FIG. 12 has a modified base member 2 with respect to the embodiment of FIG. 1, in the case of which base member 2 the annular elevation 2B is not double-walled but single-walled. Owing to the flatter form of the annular elevation 2B in comparison with that in FIG. 7, lower removal forces result for the inner container 6, which forces must be applied manually by the user by screwing open by means of the gripping member 20, in order to go from the storage position to the operating position.

We claim:

1. A two-component packaging for pourable media, having a storage position and an operating position, comprising:

an outer container, having an inner side, and containing during the storage position, a first component of the media;

an elongated inner container, containing during the storage position, a second component of the media, said inner container being partially disposed within said outer container and being longitudinally displaceable from the storage position to the operating position, said outer container having a neck portion containing a sealing lip made of resiliently flexible material and having a free end disposed substantially parallel to the longitudinal axis of said inner container and being rigidly connected to said inner side of said outer container, said sealing lip lying closely against said inner container in a contact region and extending in said contact region outwardly from the interior of said outer container in the direction towards said free end of said lip, so as to release into the ambient possible overpressure in said outer container, said inner container also having a lateral wall with at least one projection extending radially outwardly and said outer container having a recessed stop for said projection in the vicinity of said sealing lip, so that said projection limits the longitudinal displacement of said inner container during the transfer from the storage position to the operating position, said outer container having a lateral wall and a base member having a central zone surrounded by annularly disposed projections and lying closely against said lateral wall of said inner container in the storage position, said base member being more flexible and more easily deformable than said laterial wall of said outer container, so that an overpressure in said inner container can be reduced by the deformation of said base member allowing an amount of a media to pass from said inner container to said outer container.

2. A packaging as claimed in claim 1, in which the projections disposed in an annular manner are formed as an annular elevation (2B) which lies closely against the inner side of the lateral wall (7) of the inner container (6) in the storage position.

3. A packaging as claimed in claim 1 or 2, in which the base member (2) has a central zone (2A) which is inwardly retracted.

4. A packaging as claimed in claim 1, in which in the region of the sealing lip (17) on the side thereof facing the interior of the outer container (1) a chamber (19) is provided and the projection (8) on the outer side of the inner container (6) is formed in such a way that during the transfer into the operating position it can be pushed into the interior of the chamber (19).

5. A packaging as claimed in claim 1, in which the outer container (1) has an internal thread (15) on its inner side and the inner container (6) has an external thread (16) on its outer side, and the two threads are disposed in relation to the longitudinal dimension of the two containers such that, in the storage position, the thread (16) of the inner container (6) is screwed into the thread (15) of the outer container (1).

6. A packaging as claimed in claim 1, in which one end of the lateral wall (3) of the outer container (1), which end faces the base member (2), has on its inner side a stop which projects inwards and against which the base member (2) abuts.

7. A packaging as claimed in claim 1, in which the base member (2) is inserted in an annular groove of the lateral wall (3) of the outer container (1).

8. A packaging as claimed in claim 1, in which the base member (2) is more flexible and more easily deformable than the lateral wall (7) of the inner container (6).

9. A packaging as claimed in claim 1, in which the lateral wall (3) of the outer container (1) and the base member (2) consist of polyethylene or polypropylene.

10. A packaging as claimed in claim 1, in which at least the central zone (2A) the base member (2) is covered externally by an aluminium sheet (33).

11. A packaging as claimed in claim 10, in which the aluminium sheet (33) is connected on the side facing the base member (2) to a plastics sheet (32) whose outer edge is fused with the base member (2).

12. A packaging as claimed in claim 1, in which the outer side of the inner container (6) has a groove (21) which extends in the longitudinal direction and is disposed in such a manner that in the storage position it is located with its entire length in the interior of the outer container (1), but in the operating position it is partially in the interior of the outer container.

13. A packaging as claimed in claim 1, in which the inner container (6) is provided with a gripping member (20) outside the outer container (1).

14. A packaging as claimed in claim 1, in which the outer container (1) has an oval cross-section.

15. A packaging as claimed in claim 1, in which at least the part of the inner container (6) that is located inside the outer container (1) has a circular cross-section.

16. A packaging as claimed in claim 1, in which, in the storage position, a hair colouring component is contained in one of the containers (1,6) and a hydrogen peroxide component is contained in the other.

17. A packaging as claimed in claim 1, in which the end of the inner container (6) adjacent to the base member (2) is closed by an aluminium bonding sheet (31) and the base member (2) bears at least one inwardly projecting cutter tooth (35) spaced from and facing the aluminium bonding sheet (31) in the storage position.

18. A packaging as claimed in claim 17, in which the base member (2) is resiliently deformable.

19. A packaging as claimed in claim 18, in which the inner container (6) is displaceable from the storage position axially towards the cutter teeth (35) into a lower intermediate position to an extent such that the aluminium bonding sheet (31) is cut open.

20. A packaging as claimed in claim 1, in which the projections (34) disposed in an annular manner around the central zone (2A) of the base member (2) have an longitudinal internal profile which tapers away from the base member (2), and form a conical opening funnel in which the inner container (6) is received in the storage position.

21. A packaging as claimed in claim 20, in which the projections (34), in the storage position, contact the outside of the at least one radial projection (8) on the lateral wall (7) of the inner container (6).

* * * * *